US006192841B1

(12) United States Patent
Vorih et al.

(10) Patent No.: US 6,192,841 B1
(45) Date of Patent: Feb. 27, 2001

(54) DEVICE TO LIMIT VALVE SEATING VELOCITIES IN LIMITED LOST MOTION TAPPETS

(75) Inventors: Joseph M. Vorih, Suffield; Kevin J. Kinerson, Vernon, both of CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/196,314

(22) Filed: Nov. 20, 1998

Related U.S. Application Data

(60) Provisional application No. 60/066,378, filed on Nov. 21, 1997.

(51) Int. Cl.[7] ..... F01L 1/16

(52) U.S. Cl. ..... 123/90.12; 123/90.16; 123/90.49

(58) Field of Search ..... 123/90.11, 90.12, 123/90.13, 90.15, 90.16, 90.22, 90.48, 90.49

(56) References Cited

U.S. PATENT DOCUMENTS 5,069,173 * 12/1991 Mallas ..... 123/90.61
5,158,048 * 10/1992 Robnett et al. ..... 123/90.16
5,190,262 * 3/1993 Woollatt ..... 251/48
5,193,494 * 3/1993 Sono et al. ..... 123/90.12
5,216,988 * 6/1993 Taxon ..... 123/90.12
5,275,136 * 1/1994 Schechter et al. ..... 123/90.12
5,421,359 * 6/1995 Meister et al. ..... 137/12
5,451,029 * 9/1995 Kruger ..... 251/48
5,485,813 * 1/1996 Molitor et al. ..... 123/90.12
5,531,192 * 7/1996 Feucht et al. ..... 123/90.12
5,577,468 * 11/1996 Weber ..... 123/90.12
5,673,661 * 10/1997 Jesel ..... 123/90.48
5,829,397 * 11/1998 Vorih et al. ..... 123/90.12
5,832,883 * 11/1998 Bae ..... 123/90.11

* cited by examiner

*Primary Examiner*—Weilun Lo
(74) *Attorney, Agent, or Firm*—David R. Yohannan; Collier Shannon Scott, PLLC

(57) ABSTRACT

An internal combustion engine valve actuation system is disclosed. The present invention provides a hydraulic actuator for operating an engine valve, which includes a control element for controlling the seating velocity of the valve. The present invention provides for free, unrestricted movement of the valve during opening, and an unrestricted return of the valve until the valve is within a predetermined distance of the valve seat. Once within this predetermined range, the return velocity of the engine valve is limited by the rate at which a fluid may escape through a flow restriction. The restriction is calibrated to provide the desired maximum valve seating velocity.

28 Claims, 8 Drawing Sheets

DEVICE TO LIMIT VALVE SEATING VELOCITIES IN LIMITED LOST MOTION TAPPETS

CROSS REFERENCE TO RELATED PATENT APPLICATIONS

This application relates to and claims priority to U.S. Provisional Patent Application Ser. No. 60/066,378, entitled "DEVICE TO LIMIT VALVE SEATING VELOCITIES IN LIMITED LOST MOTION TAPPETS" filed on Nov. 21, 1997.

FIELD OF THE INVENTION

The present invention relates generally to systems and methods for opening valves in internal combustion engines. More specifically the invention relates to systems and methods, used both during positive power and engine braking, for controlling the amount of "lost motion" between a valve and a means for opening the valve. The invention also relates to a means for controlling the seating velocity of the valve.

BACKGROUND OF THE INVENTION

In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Typical lost motion systems have not had the combined capability of providing an adequate fail-safe or "limp home" mode of operation and of providing variable degrees of valve lift over an entire range of cam lobe positions. In previous lost motion systems, a leaky hydraulic circuit could disable the master piston's ability to open its associated valve(s). If a large enough number of valves cannot be opened at all, the engine cannot be operated. Therefore, it is important to provide a lost motion system which enables the engine to operate at some minimum level (i.e., at a limp home level) should the hydraulic circuit of such a system develop a leak. A limp home mode of operation may be provided by using a lost motion system which still transmits a portion of the cam motion through the master and slave pistons and to the valve after the hydraulic circuit therefor leaks or the control thereof is lost. In this manner the most extreme portions of a cam profile can still be used to get some valve actuation after control over the variable length of the lost motion system is lost and the system has contracted to a minimum length. The foregoing assumes of course that the lost motion system is constructed such that it will assume a fully contracted position should control over it be lost and that the valve train will provide the minimum valve actuation necessary to operate the engine when the system is fully contracted. The amount of motion which may be "lost" is limited so that some of the cam motion is transmitted to the engine valve. In this manner the lost motion system may be designed to allow the engine to operate, albeit not optimally, so that an operator can still "limp home" and make repairs. A lost motion system with "limp home" capability may be alternatively referred to as a limited loss motion system.

Kruger, U.S. Pat. No. 5,451,029 (Sep. 19, 1995), for a Variable Valve Control Arrangement, assigned to Volkswagen AG, discloses a lost motion system which when fully contracted may provide some valve actuation. Kruger does not, however, disclose that the lost motion system may be designed such as to provide limp home capability. Kruger rather discloses a lost motion system which starts from a fully contracted position upon every cycle of the engine. The lost motion system thereby provides a base level of valve actuation when fully contracted, such base level being modifiable only after the lost motion system has been displaced a predetermined distance. It follows therefore that the Kruger lost motion system is undesirably limited to starting from a fully contracted position each engine cycle and cannot vary the amount of lost motion until after the lost motion system has been displaced by a cam motion.

Previous lost motion systems have typically not utilized high speed mechanisms to rapidly vary the length of the lost motion system. Lost motion systems of the prior art have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

The lost motion system and method of the present invention may be particularly useful in engines requiring valve actuation for both positive power and for compression release retarding and exhaust gas recirculation valve events. Typically, compression release and exhaust gas recirculation events involve much less valve lift than do positive power related valve events. Compression release and exhaust gas recirculation events may however require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, it may be beneficial to have a lost motion system which is capable of providing control over positive power, compression release, and exhaust gas recirculation events, and which will provide only positive power or some low level of compression release and exhaust gas recirculation valve events, should the lost motion system fail.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

In addition, U.S. Pat. No. 5,829,397 (the '397 patent), incorporated by reference herein, discloses a lost motion system and method for precise control of valve actuation to optimize valve movement for different engine operating conditions, while maintaining an acceptable limp home capability. Furthermore, the '397 patent discloses the use of a high speed lost motion system capable of varying the amount of lost motion during a valve event such that the system independently controls valve opening and closing times, while maintaining an acceptable limp home capability. Such independent control may be realized by modifying a standard cam lobe initiated valve opening event with precise amounts of lost motion, which may range between a minimum and maximum amount at different times during the valve event. In addition, the '397 patent discloses a system for defaulting to a predetermined level of positive power valve actuation (which may or may not include some exhaust gas recirculation) should control of the lost motion system be lost. The tappet of the present invention may be incorporated into the systems disclosed in the '397 patent.

Prior art systems have utilized dampening devices in conjunction with lost motion systems to control the valve seating velocity through the temporary restriction of fluid flow. U.S. Pat. No. 5,485,813 to Molitor et al. discloses the use of a dampening device to reduce valve seating velocity. Molitor et al. reduces the rate of change of fluid flow by providing staggered free flow ports which are gradually closed off. The dampening device of Molitor et al. is directed solely to a lost motion system capable of losing all of the motion imparted by the cam to the valve. The prior art does not disclose, teach or suggest any method for controlling engine valve seating velocity in conjunction with a lost motion system with limp home capability.

Typically, valve seating velocity control is for the full range of slave piston travel. Full range valve seating control does not allow for fine control of engine valve closing since the seating velocity is controlled for the entire valve closing stroke. Therefore, it is desirable to control valve seating velocity for the limited range just prior to valve seating.

Accordingly, there is a significant need for a system and method of controlling lost motion which also provides a means for controlling the seating velocity of the engine valve.

OBJECTS OF THE INVENTION

It is therefore an object of the present invention to provide a system and method for optimizing engine operation under various engine operating conditions by valve actuation control.

It is a further object of the present invention to provide a system and method for providing precise control of the lost motion in a valve train.

It is another object of the present invention to provide a system and method for limiting the amount of lost motion provided by a lost motion system.

It is a further object of the present invention to provide a system and method for controlling the amount of lost motion provided by a lost motion system.

It is still a further object of the present invention to provide a system and method of valve actuation which provides a limp home capability.

It is yet another object of the present invention to provide a system and method for achieving variation of the length of a lost motion system.

It is yet a further object of the invention to provide a system and method for selectively actuating a valve with a lost motion system for positive power, compression release retarding, and exhaust gas recirculation modes of operation.

It is still a further object of the invention to provide a system and method for valve actuation which is compact and light weight.

It is an object of the present invention to provide an economical integral design which includes a means for limiting the seating velocity for engine valves in a lost motion system.

It is still another object of the present invention to provide a means for controlling engine valve seating velocity in a loss motion system without compromising the mechanical fail-safe nature of the limited lost motion.

It is another object of the present invention to provide full range valve seating velocity control for a limited loss motion system.

It is a further object of the present invention to provide limited range valve seating velocity control for a limited loss motion system.

Additional objects and advantages of the invention are set forth, in part, in the description which follows and, in part, will be apparent to one of ordinary skill in the art from the description and/or from the practice of the invention.

SUMMARY OF THE INVENTION

In response to this challenge, Applicants have developed an innovative and reliable system and method to achieve control of an engine valve using lost motion. The present invention may comprise a valve actuation system for actuating engine valves in an internal combustion comprising: a valve train element; a variable length tappet for transmitting motion of the valve train element to an engine valve element causing an engine valve to open, wherein the tappet includes an internal variable volume fluid chamber; a fluid control element in hydraulic communication with the tappet for controlling the length of the variable length tappet through the control of hydraulic fluid flow to and from the variable volume fluid chamber; and a velocity control element that provides a restriction in hydraulic fluid flow from the variable length tappet during the closing stroke of the engine valve thereby limiting the seating velocity of the engine valve.

The variable length tappet may comprise a master piston slidably disposed within a bore of a slave piston or a slave piston slidably disposed within a bore of a master piston such that a variable volume fluid chamber is formed between the pistons. The master piston may be placed adjacent the valve train element and the slave piston may be adjacent the engine valve element. The valve train element may comprises a rocker arm, or a rotating cam, or a hydraulic linkage. The valve train element may comprise a valve stem or a valve push tube. The fluid control element may comprise a trigger valve. The trigger valve may be controlled by an electronic controller.

The velocity control element may be a disc disposed within the tappet's variable volume chamber. The disc may include a central orifice to restrict fluid flow. The disc may also include a plurality of orifices to restrict fluid flow. The fluid control element may be hydraulically linked to the variable length tappet and the variable volume chamber by a fluid passage. The fluid control element may be a flow restriction in the fluid passage. The velocity control element may be a pin disposed within the variable volume chamber. The pin may be biased into the fluid passage so that a flow restriction is created.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE INVENTION

Figure 1:
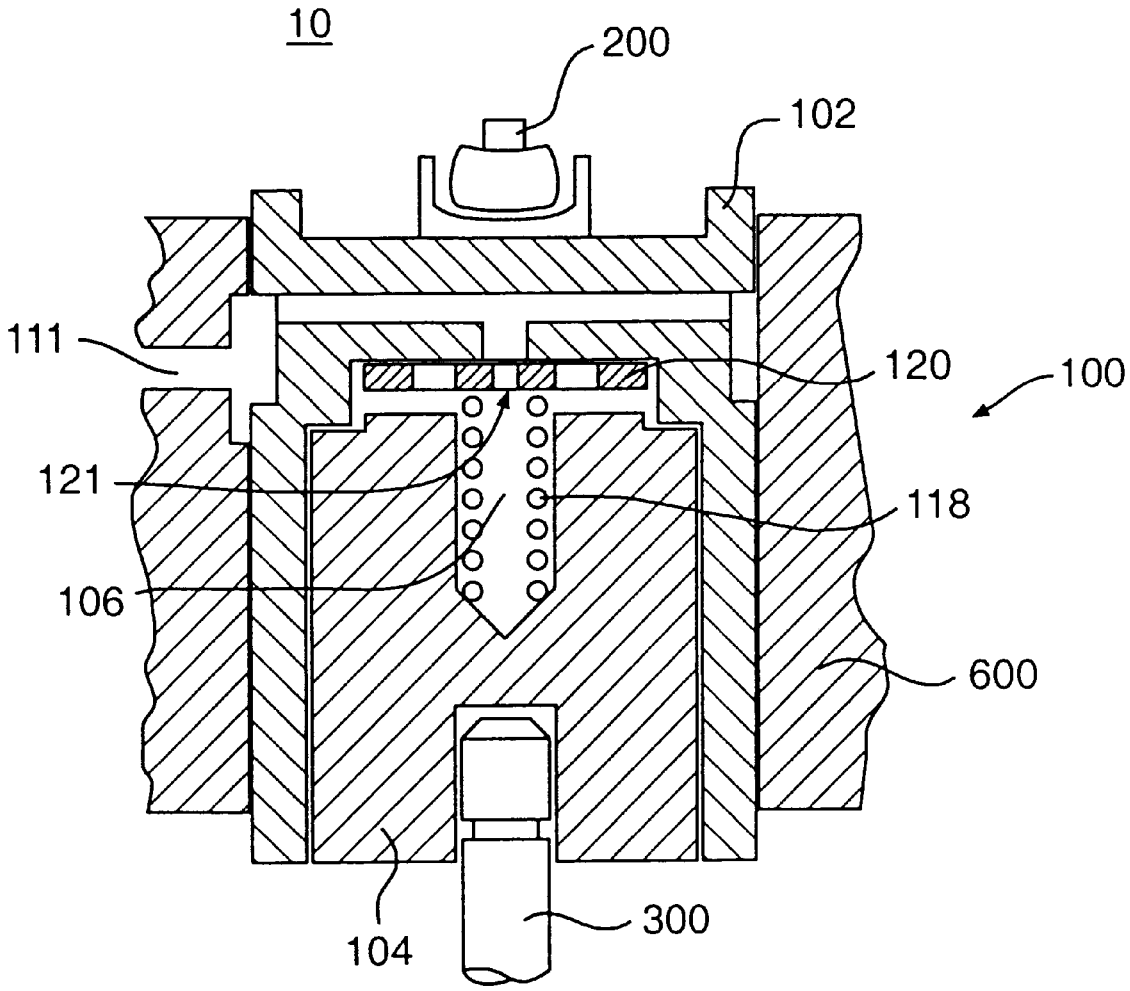
FIG. 1 is a cross sectional view of the present invention.

A valve actuation system according to the present invention is shown in FIG. 1. The valve actuation system 10 may include a variable length tappet 100 which connects a valve train element 200 with an engine valve element 300.

The variable length tappet 100 may comprise any means for transmitting a force between the valve train element 200 and the valve 300, which can be varied between plural operative lengths. Preferably the variable length tappet 100 may be limited to a minimum operative length which enables some minimum force to be transmitted between the valve train element 200 and the valve 300. The valve train element 200 may take a number of different forms, such as a mechanical linkage, a hydraulic circuit, a hydromechanical linkage, and/or an electromechanical linkage, for example.

Motion may be imparted to the valve train element 200 by any engine or vehicle component from which a force may be derived, or even from which a cyclical signal may be derived to control actuation of a stored force. In the preferred embodiment a rotating cam is provided, however the invention need not be limited to a cam driven design in order to be operative.

Engine valve element 300 includes cylinder exhaust and intake valves. The variable length tappet 100 may transmit motion to an engine valve stem directly, or through a rocker arm to plural engine valves 300.

With continued reference to FIG. 1, the variable length tappet 100 may comprise a slave piston 104 slidably disposed in a master piston 102. The master piston 102 and slave piston 104 may have any complimentary cross-sectional shape, such as coaxial, concentric cylinders or ellipses, so long as the slave piston is slidable within the master piston such that a sealed chamber 106 of variable volume may be formed by the pistons. It should be noted that the hydraulic ratio of the master piston 102 and the slave piston 104 may vary in accordance with the parameters of the engine in which the system is to be used. In order to obtain various hydraulic ratios, the arrangement and relative sizes of the master and slave pistons may vary widely.

The tappet 100 disclosed in FIG. 1 comprises a guide housing 600 which is placed between the engine valve element 300 and the valve train element 200. The guide housing 600 may be an integral portion of an engine head or block and the tappet 100 may thereby be slidably disposed directly in the engine head or block. The housing 600 includes fluid inlet and outlet passage 111. Passage 111 connects the tappet 100 to a trigger valve (not shown). The trigger valve may be positioned to vent passage 111 and tappet 100 to either a sump or storage accumulator. Contained within the housing 600 are the outer master piston 102 and the inner slave piston 104. The master piston 102 contacts the valve train element 200 and the slave piston 104 contacts the engine valve element 300.

The trigger valve may be controlled by a control system. The control system not shown may comprise any electronic or mechanically actuated means for selecting the length of the variable length tappet 100. The control system may include a microprocessor, linked to other engine components, to determine and select the appropriate length of the variable length tappet 100. Valve actuation may be optimized at plural engine speeds by controlling the length of the variable length tappet 100 based upon information collected at the microprocessor from engine components.

The control system may be connected to and/or in communication with the trigger valve by any one of numerous communication schemes, including but not limited to, a hard-wired electrical connection, a hydraulic connection, a mechanical connection, a wireless radio connection, and/or any combination of the foregoing. Preferably, the control system and the trigger valve may comprise a "high speed" device capable of varying the length of the variable length tappet 100, one or more times per cycle of the engine in which the valve actuation system 10 is installed.

Using the control system, the valve actuation system 10 may be controlled by selectively varying the length of the variable length system 100 to vary the amount of force and/or displacement which is transmitted from the valve train element 200 to the engine valve element 300. In such a way the valve actuation system may optimize engine operation under various engine operating conditions, provide precise control of the motion lost by the variable length tappet 100, provide acceptable limp home capability, and/or provide for high speed variation of the length of the variable length tappet 100.

The master piston 102 includes passages to allow filling of the hydraulic chamber 106 formed between the two pistons. A flow-restricting disc 120 is positioned between the two pistons such that, when the disc 120 is against the master piston 102, the flow of oil out of the tappet 100 is restricted by a central orifice 121 in the disc 120. When the disc 120 is against the slave piston 104, oil can flow freely into the cavity 106 between the two pistons. A spring 118 biases the disc 120 toward the master piston 102.

Figure 4:
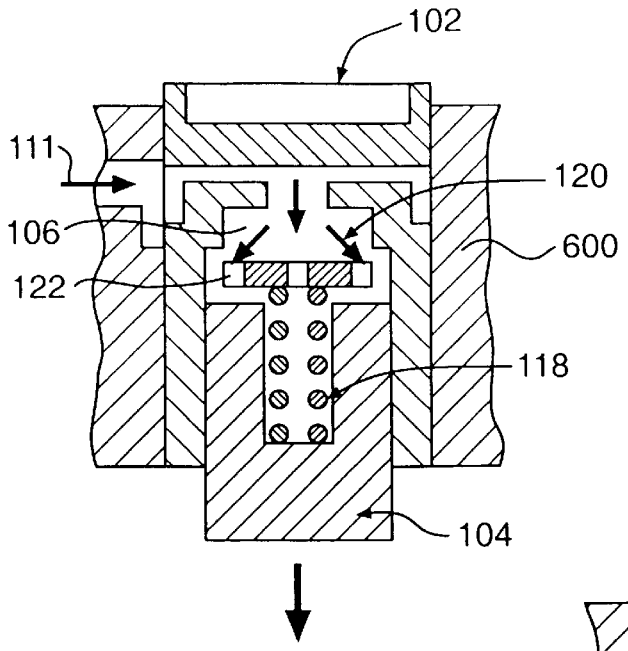
FIG. 4 is another cross sectional representation of the embodiment of the present invention shown in FIG. 1.
Figure 5:
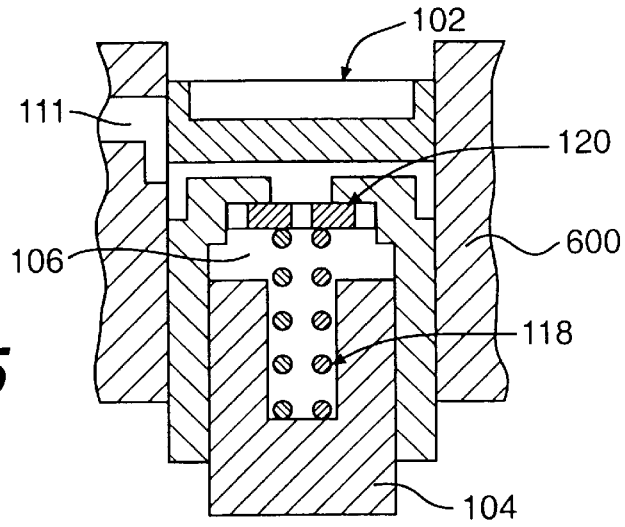
FIG. 5 is another cross sectional representation of the embodiment of the present invention shown in FIG. 1.
Figure 6:
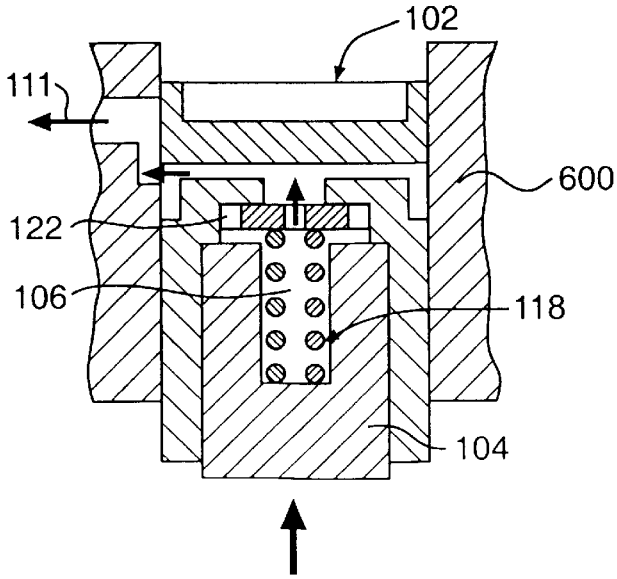
FIG. 6 is another cross sectional representation of the embodiment of the present invention shown in FIG. 1.

The operation of the tappet 100 is shown in FIGS. 4–6. When the chamber 106 is at a pressure less than that required to overcome the biasing of the exhaust valve spring, there is no hydraulic link between the master piston 102 and the slave piston 104. However, the master piston 102 still mechanically engages the slave piston 104 to provide some valve opening force (i.e. some displacement) from the valve train element 200 to the valve element 300. In order to transmit greater valve opening force to valve element 300 and to establish a full hydraulic link between the master piston 102 and the slave piston 104, hydraulic fluid is provided to the tappet 100. The hydraulic fluid may be provided to the tappet 100 from a source of engine lubricant (not shown) through passage 111 into chamber 106. As shown in FIG. 4, the incoming fluid flows into the slave piston 104, and pushes down the valve seating control disc 120. Free flow of oil is achieved through the center orifice 121 and side orifices 122 of disc 120. The fluid fills the slave piston 104 without restriction, taking up the full lash between the master piston 102 and the slave piston 104.

Once the chamber 106 is full and fluid flow is stopped, as shown in FIG. 5, the valve seating control disc 120 is biased upward by the spring 118. The trigger valve closes and fluid flow into or out of the tappet 100 stops. Full motion of the valve train element 200 is imparted to the engine valve element 300, with no lost motion. The master piston 102 and slave piston 104 move together as a solid link.

When lost motion is desired, the trigger valve opens to vent the chamber 106. The tappet 100 begins to collapse at a rate proportional to the rate at which fluid escapes from the slave piston 104. The slave piston 104 moves toward the master piston 102 at a controlled rate since the flow of oil is limited by the size of the center orifice 121 in disc 120. The velocity of the engine valve element 300 and the engine valve toward its seat is similarly limited. Should valve seating occur while the tappet 100 is collapsing, the velocity at which the valve impacts the seat is limited by the flow of oil through the orificed disc 120. The disc 120 restricts fluid flow out of the tappet 100. As shown in FIG. 6, valve seating velocity is limited throughout the full range of the travel of the slave piston 104. Therefore, the embodiment shown in FIG. 1 may be referred to as a full range valve seating velocity control system.

Figure 2:
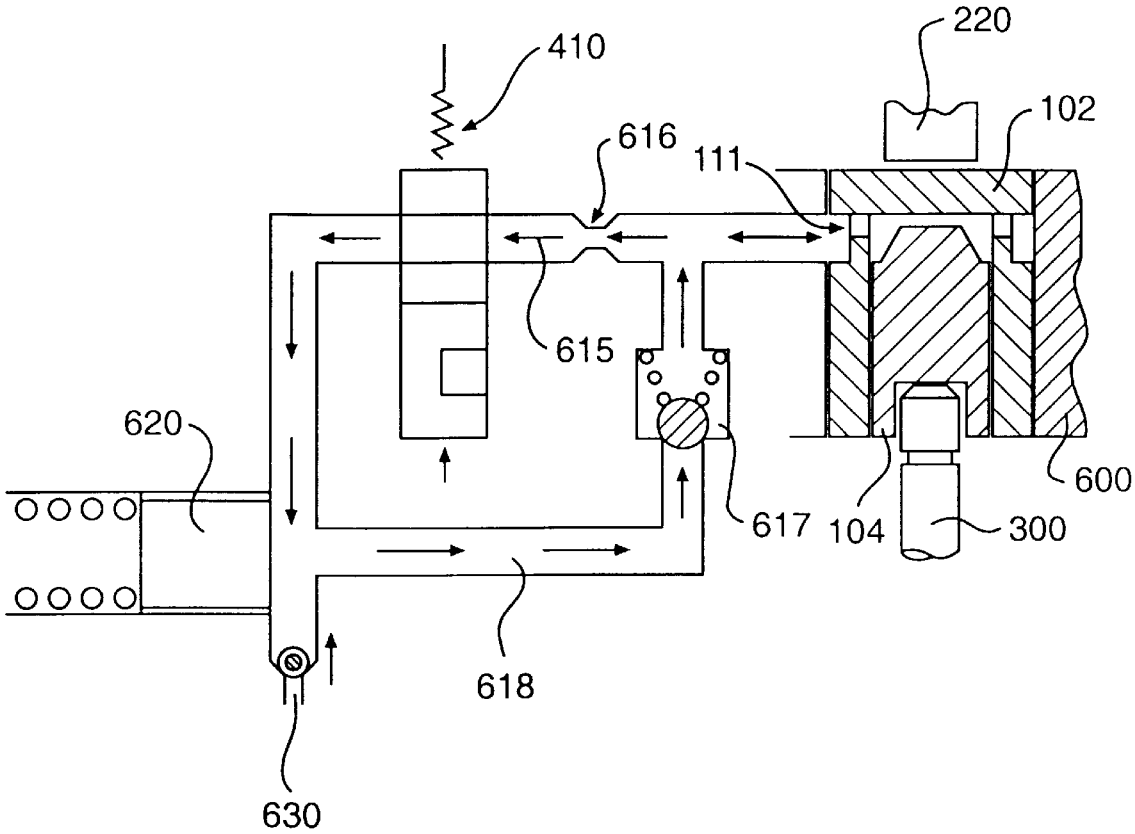
FIG. 2 is a combination schematic cross sectional representation of another alternative embodiment of the present invention.

In an alternative embodiment, shown in FIG. 2, the tappet 100 is placed between the engine valve 300 and engine valve actuation source 200. Contained within the tappet 100 are a pair of concentric pistons having an outer master piston 102 and an inner slave piston 104. Oil is supplied to the tappet 100 by means of a dedicated passage 618 with a high-pressure check valve 617. The passage 618 has very low flow restriction. A trigger valve 410 may also be provided. The trigger valve 410 may, for example, be similar to the trigger valves disclosed in Sturman, U.S. Pat. No. 5,460,329 (issued Oct. 24, 1995), for a High Speed Fuel Injector; and/or Gibson, U.S. Pat. No. 5,479,901 (issued Jan. 2, 1996) for a Electro-Hydraulic Spool Control Valve Assembly Adapted For A Fuel Injector. When trigger valve 410 opens the fluid between the pistons escapes, and tappet 100 begins to collapse. When the tappet 100 collapses, oil must flow through a separate passage 615 equipped with a specific orifice 616 to control the velocity of the flow. Similar to the embodiment shown in FIG. 1, the tappet 100 in FIG. 2 provides full range velocity limited valve seating.

The trigger valve 410 may simultaneously block and unblock the hydraulic passage 615 leading to the tappet 100 and a second passage leading to a second tappet (not shown). In this manner one trigger valve may control the operation of two (or even more) tappets. In alternative embodiments, the trigger valve 410 need not be a solenoid activated trigger, but could instead be hydraulically or mechanically activated. No matter how it is implemented however, the trigger valve 410 preferably is capable of providing one or more opening and closing movements per cycle of the engine and/or one or more opening and closing movements during an individual valve event.

Should there be a failure in the system which prevents the variable length tappet 100 from receiving hydraulic fluid, the valve actuation system will default to a setting of maximum lost motion which results in there being a minimum amount of valve opening. The maximum amount of lost motion may be predetermined to provide some degree of the valve actuation necessary for engine positive power operation, and little or no compression release retarding or exhaust gas recirculation valve actuation. The maximum amount of lost motion would thereby allow the engine to produce some level of positive power and possibly some levels of compression release retarding and/or exhaust gas recirculation even with a valve actuation control system failure or a variable length tappet failure. If the valve actuation system did not default to a maximum lost motion setting, excessive temperatures and pressure could develop in the engine due to uncontrolled compression release retarding and/or exhaust gas recirculation at higher engine speeds if the tappet was left expanded, or no engine function could be obtained if the tappet did not "go solid."

The system 10 of FIG. 2 may also include an accumulator 620 and an oil supply source 630. The hydraulic fluid supply may comprise engine oil used for other engine functions, such as crank shaft lubrication.

In addition to the two embodiments described above, an integral restrictor can be made by substituting any combination of checking and restricting devices internally to the concentric pistons to achieve the same result (such as a small hole and a ball check valve).

Figure 3:
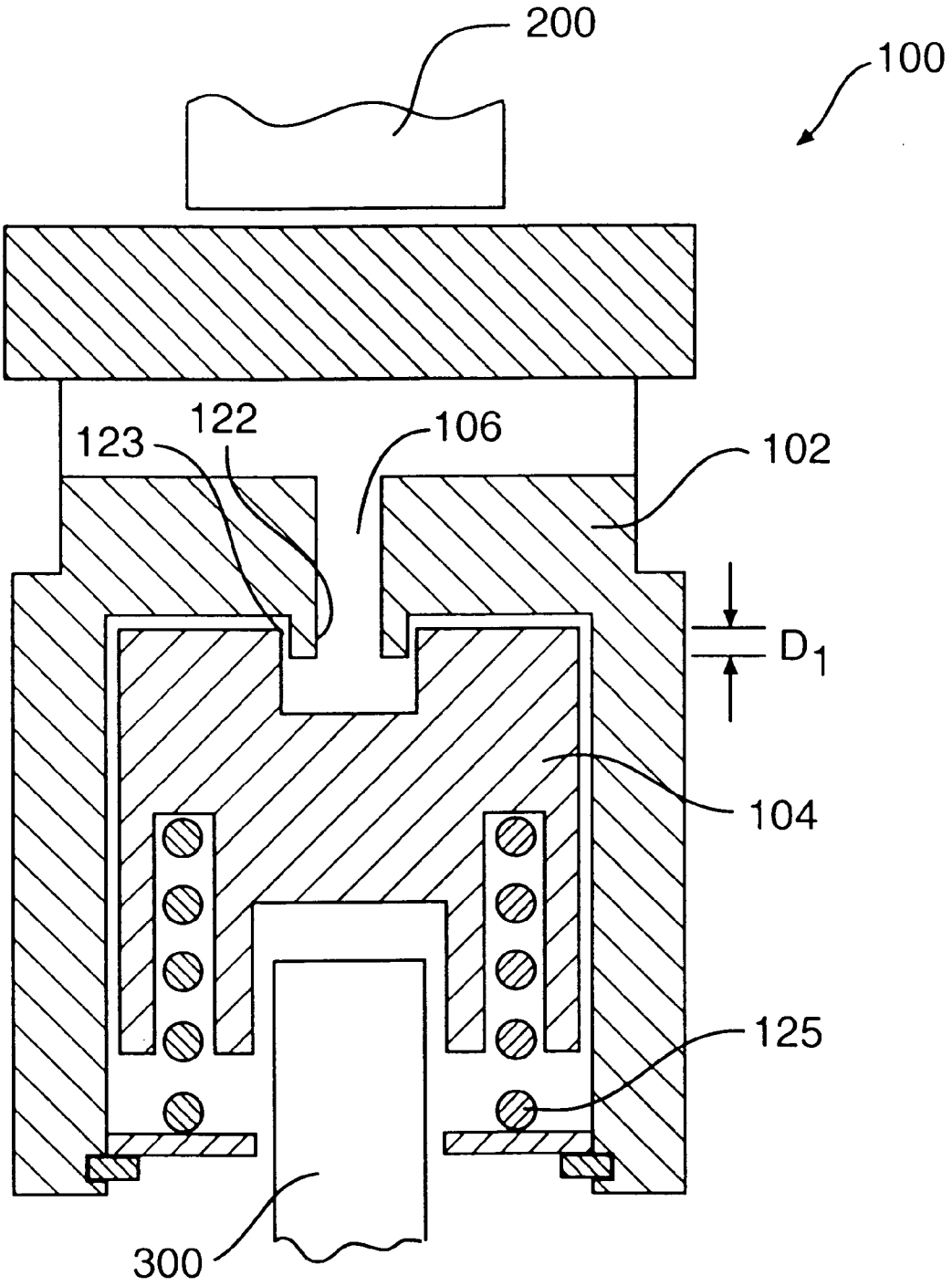
FIG. 3 is a cross sectional view of another alternative embodiment of the present invention.

FIG. 3 discloses a limited lost motion tappet 100. The tappet 100 comprises an outer master piston 102, an inner slave piston 104, and an optional biasing spring 125. The biasing spring 125 serves to bias the slave piston 104 into the master piston 102 when the fluid chamber between the pistons is vented. The master piston 102 includes a downward protruding extension 122.

The tappet design of FIG. 14 provides limited range valve seating velocity control. The valve seating velocity is only limited when the slave piston 104 collapses to the point that the top of the slave piston 104 is even with the bottom of the master piston extension 122. As the slave piston 104 continues to move upward past the extension 122, escaping fluid must follow a tortuous flow path between the collapsing master piston 102 and the slave piston 104 through a passage 123. The clearance between the master and slave pistons and, thus, the size of passage 123 may be adjusted to control valve seating velocity. Decreasing the clearance causes the rate of fluid escape to decrease and, as a result, valve seating velocity decreases. The length of the extension 122 may also be adjusted to control the range of valve seating velocity control. Valve seating velocity is limited for the limited range shown by the distance $D_1$.

Figure 7:
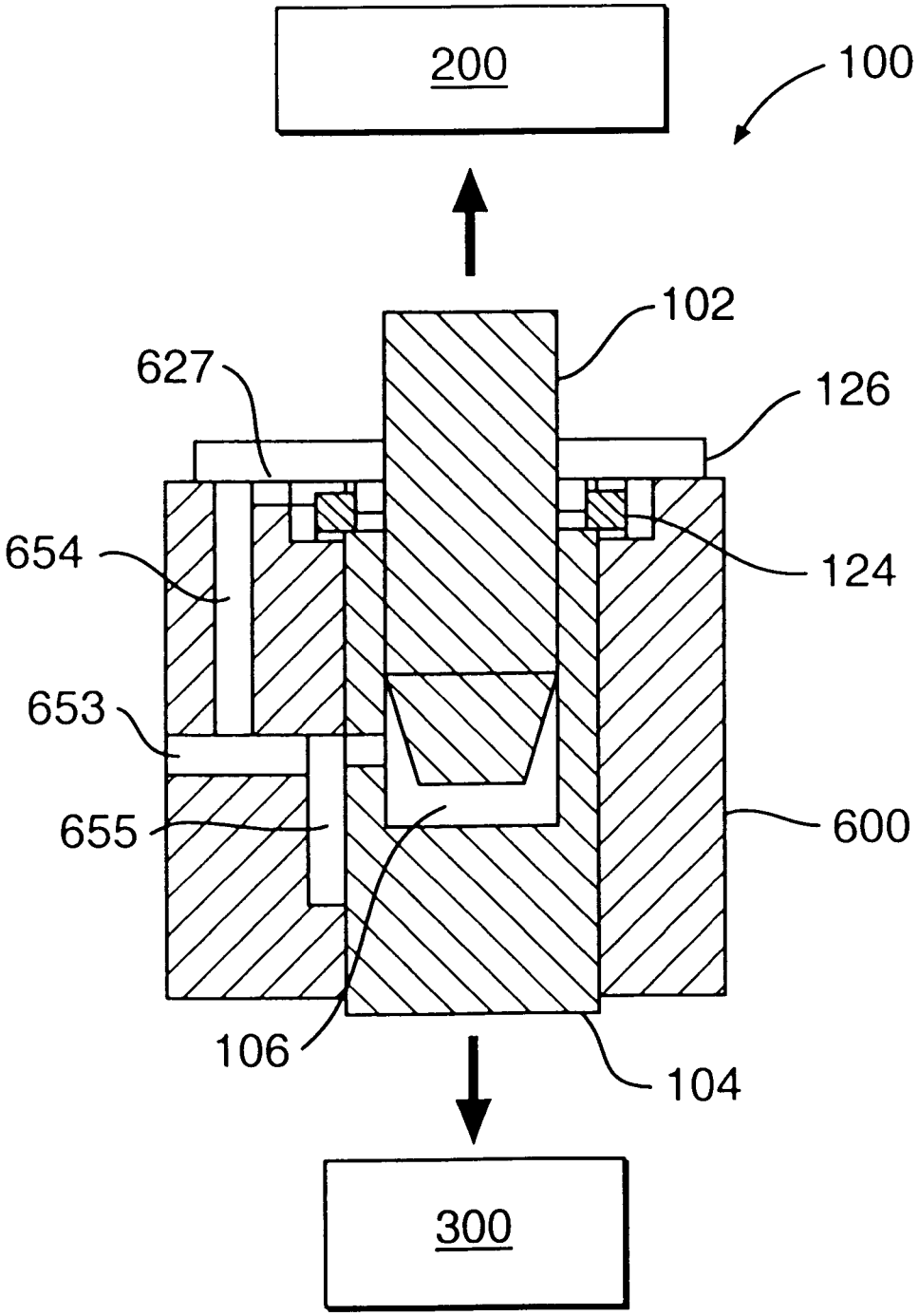
FIG. 7 is a cross sectional view of another alternative embodiment of a limited loss motion tappet according to the present invention.

FIG. 7 discloses another embodiment of the limited loss motion tappet 100. The tappet 100 is comprised of an inner master piston 102 and an outer slave piston 104. The tappet 100 further includes a velocity disc 124 and a velocity disc cap 126. The housing includes a fluid supply passage 653. Passage 653 branches into an upper fluid passage 654 porting fluid to the top of the velocity disc 124, and a lower fluid passage 655 porting fluid into the chamber 106 between the pistons. Housing 600 further includes a restricted passage 627 connecting the area above the velocity disc 124 with passage 654. As shown in FIG. 7, chamfering the master piston 102 may be preferred because it may prevent the feeding and bleeding passages, which communicate with the sealed chamber, from being occluded when the master piston abuts the slave piston 104.

When lost motion is desired, the passage 653 connecting the tappet 100 to the trigger valve is vented. Accordingly, passages 654 and 655 also vent allowing the slave piston 104 to rise freely due to the spring biasing of the engine valve 300. The slave piston 104 will continue to freely rise until it contacts velocity disc 124. The slave piston 104 forces the velocity disc 124 upward toward the velocity disc cap 126. The oil volume above the velocity disc 124 escapes through restricted passage 627. The restricted area of passage 627 limits the rate at which slave piston 104 can rise and, as a result, the valve seating velocity. Valve seating velocity is limited for the period from when the slave piston 104 contacts velocity disc 124 until the valve 300 is seated. The outer slave piston 104 is connected to the engine valve 300 and, as a result, it is known exactly where valve seating will occur. Therefore, the velocity disc 124 can be set to only operate for a short distance just prior to valve seating.

Figure 8:
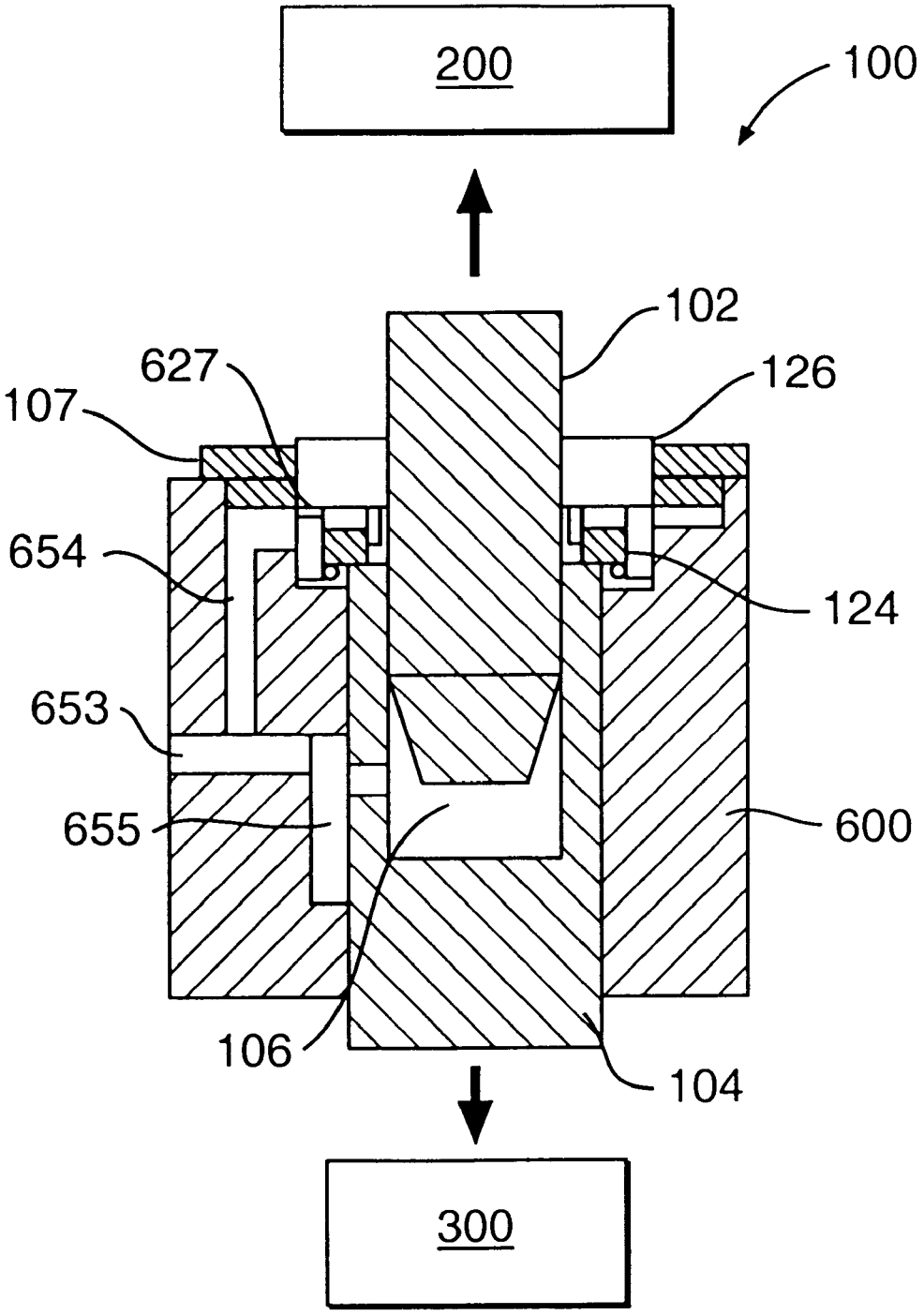
FIG. 8 is another cross sectional view of yet another embodiment of the present invention.

FIG. 8 discloses another embodiment of a limited loss motion tappet 100. The tappet 100 includes the elements of the tappet 100 design shown in FIG. 7, but also further includes a lash adjustment means 107. The lash adjustment means 107, typically a lock nut, can be adjusted for variations in engine valve lash from cylinder to cylinder. The lash adjustment means 107 adjusts the position of the velocity disc cap 126.

Figure 9:
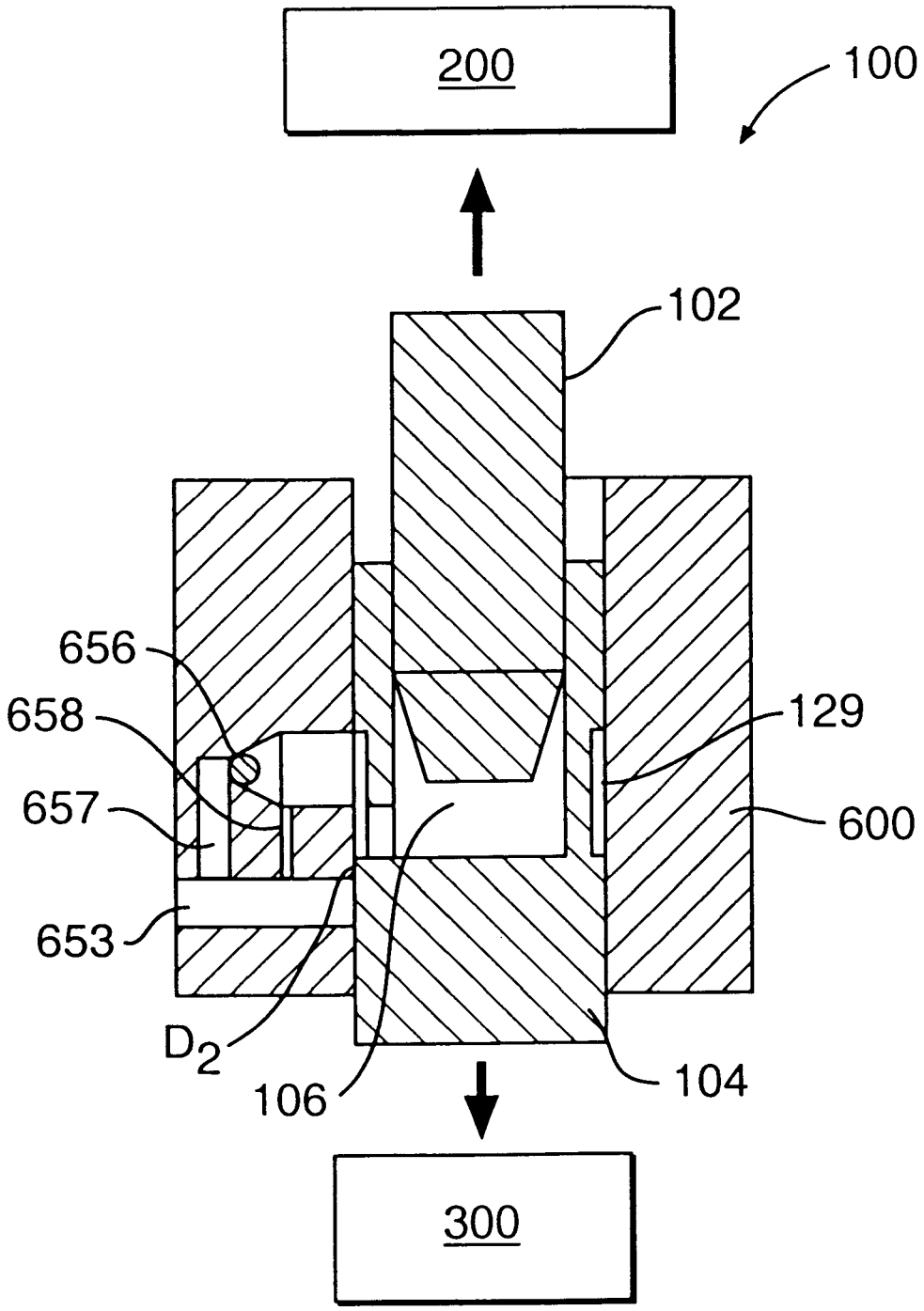
FIG. 9 is a cross sectional view of a further alternative embodiment of a limited loss motion tappet according to the present invention.

A further embodiment of the present invention is disclosed in FIG. 9. The tappet 100 shown in FIG. 21 provides limited range valve seating velocity control. The tappet 100 includes an inner master piston 102 and an outer slave piston 104. The slave piston 104 includes an outer annulus ring 129. A housing 600 is provided which includes a passage 653 connecting the tappet 100 to a trigger valve and accumulator; a ball check valve 656; a refill passage 657; and a restricted area 658.

When lost motion is desired the trigger valve positions to vent passage 653. As a result, chamber 106 is also vented and the tappet 100 begins to collapse freely. Slave piston 104 moves upward toward master piston 102. The slave piston 104 moves upward freely until the annulus ring 129 loses communication with passage 653. After the passage 653 is blocked, all of the returning fluid must flow through restricted area 658. The flow rate of the escaping fluid decreases and, as a result, the flow rate of the slave piston's upward motion and the velocity of the valve element 300 toward the valve seat also decreases. The tappet 100 provides limited range valve seating velocity control for the range in which passage 653 is blocked by the slave piston 104, and fluid must escape through the restricted passage 658. This range is indicated by the letter $D_2$. The valve seating velocity is controlled by adjusting the size of the restricted area 658.

When it is desired to reestablish the full hydraulic link between the master piston 102 and the slave piston 104, high pressure fluid is introduced into passage 653. The fluid moves through passage 657 and unseats ball check valve 656. The fluid flows into the chamber 106 and reestablishes the link between the two pistons.

Figure 10:
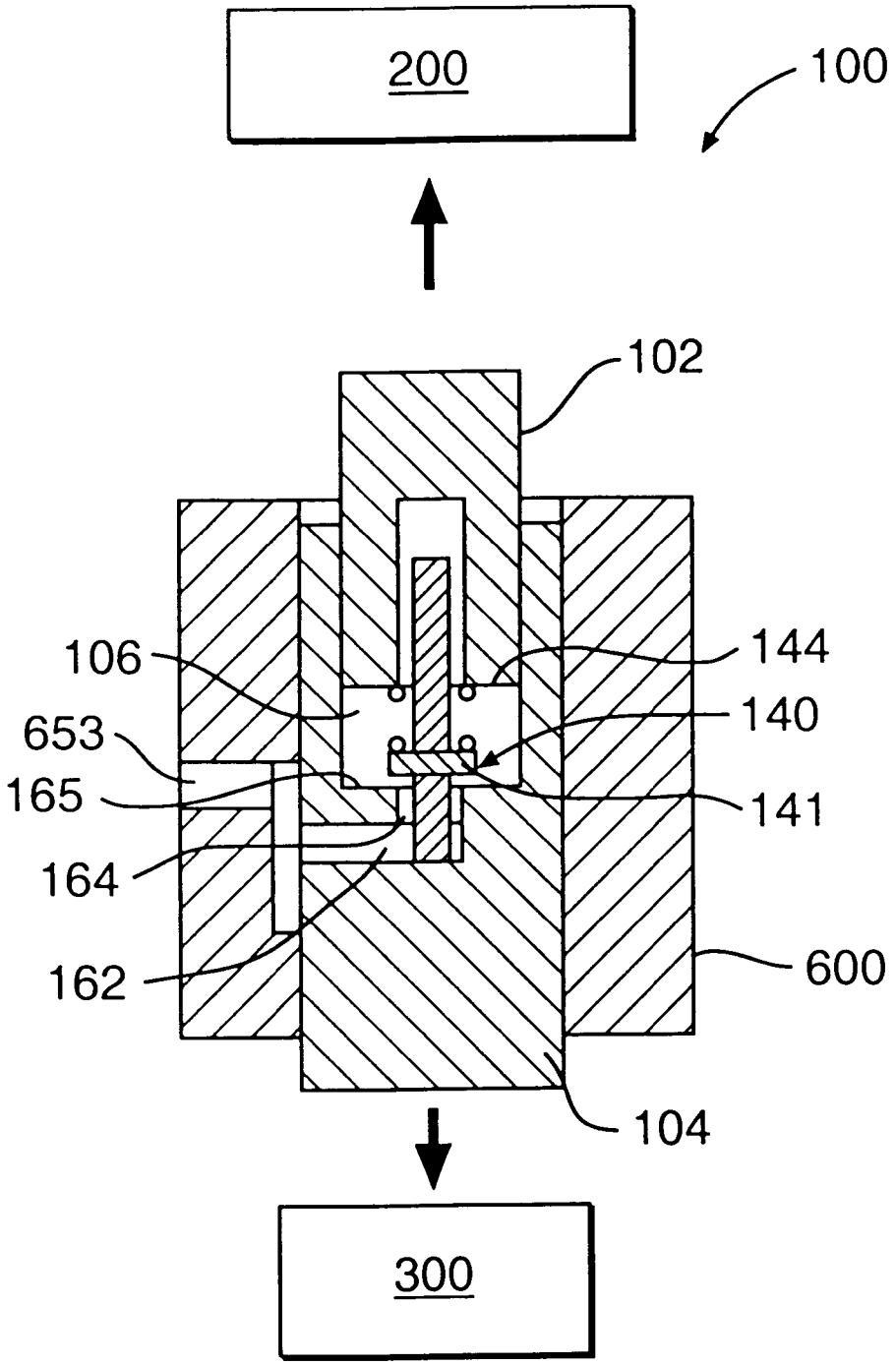
FIG. 10 is a cross sectional view of another alternative embodiment of the present invention.

FIG. 10 discloses a further embodiment of the present invention. FIG. 10 discloses a housing 600 and a tappet 100 comprised of an inner master piston 102 and an outer slave piston 104. Disposed between the pistons in chamber 106 is a flow restricting pin 140. Flow restricting pin 140 includes flow restricting pin disc 141. The flow restricting pin 140 is biased downward by flow restricting spring 144, creating a restricted area 164. Area 164 is between the bottom of the flow restricting pin disc 141 and the horizontal surface 165 of slave piston 104.

During the filling of chamber 106, the force of the incoming fluid forces disc 141 and pin 140 upward allowing the free flow of fluid into the chamber 106. Once the chamber 106 is full and fluid flow stops, spring 144 biases flow restricting pin 140 and disc 141 downward.

When lost motion is initiated, passage 653 is vented. Due to the venting of passage 653 chamber 106 vents through area 164 and passage 162. The rate at which the fluid can escape from chamber 106 is limited by the restricted area 164. The valve seating velocity is a function of the rate at which fluid escapes from the chamber 106 and, as a result, valve seating velocity is limited correspondingly. FIG. 10 discloses a tappet with full range valve seating velocity control. As the tappet 100 collapses, the rate at which fluid escapes from the tappet 100 is controlled over the full range of piston motion.

It will be apparent to those skilled in the art that various modifications and variations can be made in the construction, configuration, and/or operation of the present invention without departing from the scope or spirit of the invention. For example, in the embodiments mentioned above, various changes may be made to the tappet design without departing from the scope and spirit of the invention. Further, it may be appropriate to make additional modifications or changes to the master and slave pistons without departing from the scope of the invention. Thus, it is intended that the present invention cover the modifications and variations of the invention provided they come within the scope of the appended claims and their equivalents.

What is claimed is:

1. A valve actuation system for actuating engine valves in an internal combustion engine comprising:

a guide housing having a bore, a bore side wall, and side wall opening;

an outer piston slidably disposed in and engaged by the guide housing bore, said outer piston having an internal hydraulic passage, an internal chamber defined by an outer piston side wall, and an internal opening connecting the internal hydraulic passage and the internal chamber;

an inner piston slidably disposed in the outer piston internal chamber and engaged by the outer piston side wall, said inner piston being adapted to collapse into the outer piston;

means for selectively throttling hydraulic fluid flow through the outer piston internal opening as the inner piston collapses into the outer piston; and means for biasing the throttling means into a position adapted to provide maximum throttling of the outer piston internal opening.

2. The system of claim 1, wherein said outer piston is in contact with a valve train element selected from the group consisting of: a rocker arm, a rotating cam, an hydraulic linkage, a push tube, and a cam follower.

3. The system of claim 1, wherein said inner piston is in contact with a valve train element selected from the group consisting of: a rocker arm, a rotating cam, an hydraulic linkage, a push tube, and a cam follower.

4. The system of claim 1, further comprising an electronically controlled trigger valve adapted to control hydraulic fluid communication with the guide housing side wall opening.

5. The system of claim 1, wherein said throttling means comprises a disc disposed within said outer piston internal chamber between the outer piston internal opening and the inner piston.

6. The system of claim 5, wherein said disc includes a central orifice to restrict fluid flow.

7. The system of claim 5, wherein said disc includes a plurality of orifices to restrict fluid flow.

8. The system of claim 1 wherein said inner piston includes an interior recess and said means for biasing is at least partially disposed in the interior recess.

9. The system of claim 8 wherein said outer piston internal chamber includes a shoulder and said inner piston is adapted to selectively collapse against said shoulder.

10. The system of claim 9 wherein said outer piston includes an outer peripheral recess adapted to facilitate the ingress and egress of hydraulic fluid to and from the internal hydraulic passage.

11. The system of claim 10 wherein the biasing means is adapted to bias the throttling means into contact with the outer piston.

12. The system of claim 1 wherein said outer piston internal chamber includes a shoulder and said inner piston is adapted to selectively collapse against said shoulder.

13. The system of claim 1 wherein said outer piston includes an outer peripheral recess adapted to facilitate the ingress and egress of hydraulic fluid to and from the internal hydraulic passage.

14. The system of claim 1 wherein the biasing means is adapted to bias the throttling means into contact with the outer piston.

15. The system of claim 5 wherein said inner piston includes an interior recess and said means for biasing is at least partially disposed in the interior recess.

16. The system of claim 15 wherein said outer piston internal chamber includes a shoulder and said inner piston is adapted to selectively collapse against said shoulder.

17. The system of claim 16 wherein said outer piston includes an outer peripheral recess adapted to facilitate the ingress and egress of hydraulic fluid to and from the internal hydraulic passage.

18. The system of claim 17 wherein the biasing means is adapted to bias the throttling means into contact with the outer piston.

19. The system of claim 5 wherein said outer piston internal chamber includes a shoulder and said inner piston is adapted to selectively collapse against said shoulder.

20. The system of claim 5 wherein said outer piston includes an outer peripheral recess adapted to facilitate the ingress and egress of hydraulic fluid to and from the internal hydraulic passage.

21. The system of claim 5 wherein the biasing means is adapted to bias the throttling means into contact with the outer piston.

22. The system of claim 1 wherein the throttling means comprises an outer piston extension protruding into the internal chamber and an inner piston upper recess adapted to receive the outer piston extension.

23. The system of claim 22 wherein said inner piston includes an interior recess and said means for biasing is at least partially disposed in the interior recess.

24. The system of claim 23 wherein said outer piston includes an outer peripheral recess adapted to facilitate the ingress and egress of hydraulic fluid to and from the internal hydraulic passage.

25. The system of claim 24 wherein the biasing means is adapted to bias the inner piston into contact with the outer piston.

26. The system of claim 22 wherein said outer piston includes an outer peripheral recess adapted to facilitate the ingress and egress of hydraulic fluid to and from the internal hydraulic passage.

27. The system of claim 22 wherein the biasing means is adapted to bias the inner piston into contact with the outer piston.

28. A valve actuation system for actuating engine valves in an internal combustion engine comprising:

a guide housing having a bore therein;

an outer piston slidably disposed in the guide housing bore, said outer piston having an internal hydraulic passage, an internal chamber, and an internal opening connecting the internal hydraulic passage and the internal chamber, said internal opening being defined in part by an extension protruding into the internal chamber;

an inner piston slidably disposed in the outer piston internal chamber, said inner piston including an upper recess adapted to receive the outer piston extension and selectively throttle the egress of hydraulic fluid from the internal chamber; and means for biasing the inner piston into a position adapted to provide maximum throttling of the egress of hydraulic fluid from the internal chamber.

* * * * *